US007908772B2

(12) United States Patent
Celia

(10) Patent No.: US 7,908,772 B2
(45) Date of Patent: Mar. 22, 2011

(54) FOOTWEAR WITH ADDITIVES AND A PLURALITY OF REMOVABLE FOOTBEDS

(75) Inventor: Wayne M. Celia, Paramus, NJ (US)

(73) Assignee: Columbia Insurance Company, Omaha, NE (US)

( * ) Notice: Subject to any disclaimer, the term of this patent is extended or adjusted under 35 U.S.C. 154(b) by 842 days.

(21) Appl. No.: 11/837,946

(22) Filed: Aug. 13, 2007

(65) Prior Publication Data

US 2008/0040952 A1 Feb. 21, 2008

Related U.S. Application Data

(60) Provisional application No. 60/837,862, filed on Aug. 15, 2006.

(51) Int. Cl.
*A43B 3/24* (2006.01)
*A43B 13/38* (2006.01)

(52) U.S. Cl. ..... 36/100; 36/43

(58) Field of Classification Search ..... 36/100, 36/43, 44, 15, 45, 55
See application file for complete search history.

(56) References Cited

U.S. PATENT DOCUMENTS

| | | | | |
|---|---|---|---|---|
| 2,482,333 | A | 9/1949 | Everston | 36/43 |
| 4,015,347 | A | 4/1977 | Morishita et al. | 36/44 |
| 4,557,060 | A * | 12/1985 | Kawashima | 36/44 |
| 4,727,661 | A | 3/1988 | Kuhn | 36/100 |
| 4,967,750 | A | 11/1990 | Cherniak | 128/581 |
| 5,035,068 | A | 7/1991 | Biasi | 36/3 |
| 5,060,400 | A | 10/1991 | Finn et al. | 36/12 |
| 5,961,544 | A | 10/1999 | Goldman et al. | 607/111 |
| 6,321,464 | B1 | 11/2001 | Oberg et al. | 36/12 |
| 6,442,870 | B1 * | 9/2002 | Tsai | 36/11.5 |
| 6,536,137 | B1 | 3/2003 | Celia | 36/28 |
| 6,946,196 | B2 * | 9/2005 | Foss | 36/43 |
| 7,055,265 | B1 | 6/2006 | Bathum et al. | 36/3 |
| 2004/0016147 | A1 * | 1/2004 | Cole | 36/43 |
| 2005/0034330 | A1 * | 2/2005 | Baychar | 36/55 |
| 2007/0186442 | A1 * | 8/2007 | Amado et al. | 36/11.5 |

* cited by examiner

*Primary Examiner* — Ted Kavanaugh
(74) *Attorney, Agent, or Firm* — IP Attorneys Group LLC

(57) ABSTRACT

The invention relates to a method and shoe having a sole attached to an upper for defining an interior, the interior having a recess, and at least two footbeds, each having different physical properties and each being sized to be placed within the recess. The shoe also has an additive dispersed over the interior and at least one footbed, wherein each of the at least two footbeds is removably placed within the recess depending upon a desired physical property.

11 Claims, 11 Drawing Sheets

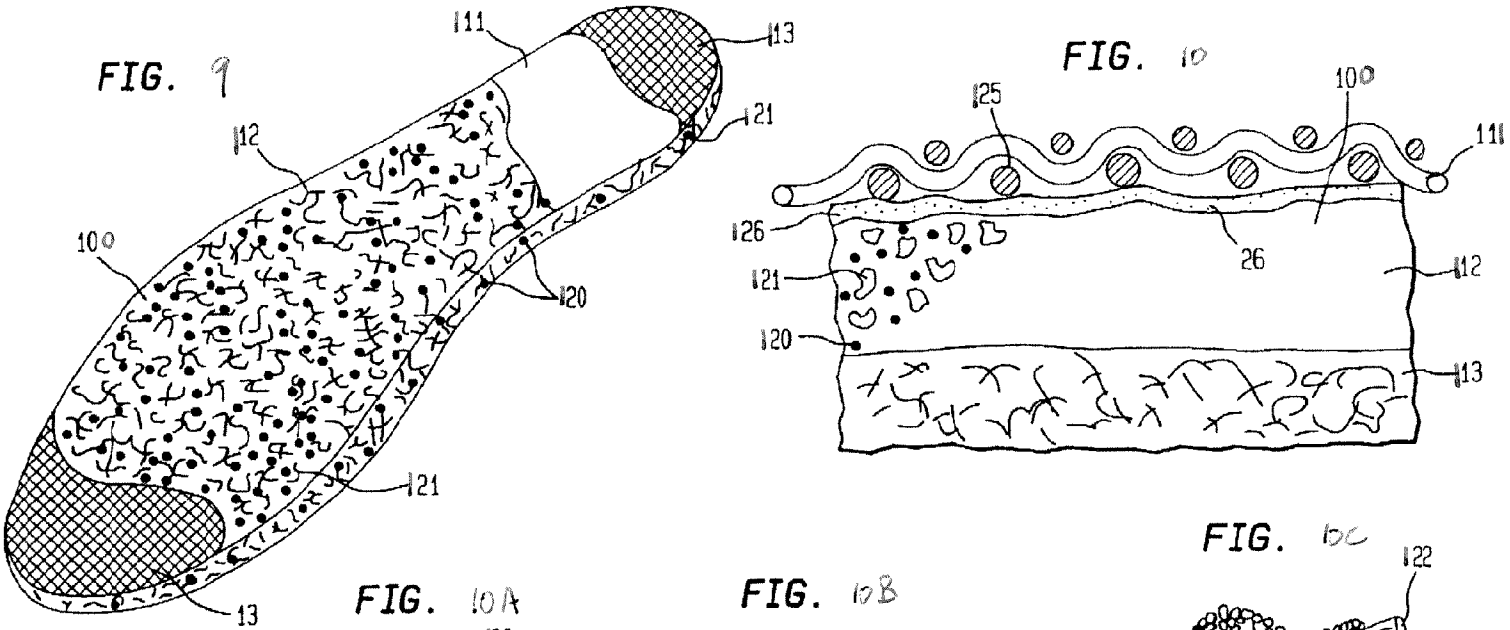
FIG. 10
FIG. 9
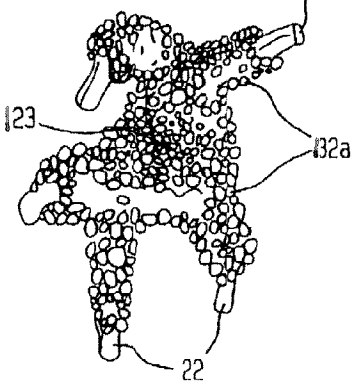
FIG. 10C
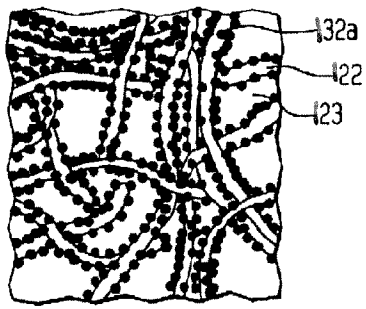
FIG. 10B
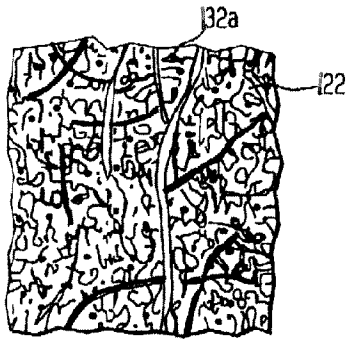
FIG. 10A

FOOTWEAR WITH ADDITIVES AND A PLURALITY OF REMOVABLE FOOTBEDS

CROSS-REFERENCE TO RELATED APPLICATIONS

The present application claims the benefit under 35 U.S.C. §119(e) of the U.S. Provisional Patent Application Ser. No. 60/837,862, filed on Aug. 15, 2006, the content of which is incorporated herein by reference.

FIELD OF THE INVENTION

The invention relates to a shoe with interchangeable footbeds and additives dispersed throughout an inside of the shoe.

BACKGROUND OF THE INVENTION

Activities such as walking, hiking, running, golfing and water sports are typically associated with specialized footwear. For example, conventional running and walking shoes may have cushioned and flexible soles to absorb shock while hiking shoes may have stiffer soles to protect against sharp rocks and other objects encountered on a trail. However, sometimes hikers who wish to have the comfort of running shoes have little choices available. Sometimes, hikers would forego comfort because a rugged sole is typically needed in tough terrain to prevent injury. Moreover, running shoes are usually not suitable for hiking because they lack ruggedness. Therefore, there is a need to provide a shoe that can be altered so that it may be used in different situations, where such a shoe may alleviate the need to have multiple shoes.

In addition, the foot often exudes perspiration, as well as odors, in varying degrees, depending upon such factors as temperature of the surroundings, the amount of physical activity being performed, and the natural propensity of the particular person to perspire. The comfort and health of the foot is normally influenced by the rate of evaporation of the perspiration generated as a result of movement and/or physical exercise. Moreover, it is common for any type of shoe to develop malodorous characteristics with use.

Some shoes employ the use of replaceable footbeds, where a worn or odorous footbed may be replaced with a new one. Although this appears to alleviate the problem, the user typically needs to change footbeds in quick fashion in order to continue to enjoy a comfortable shoe. Some methods of reducing the quick turnover in footbeds is to coat the footbeds with an odor resistant or antifungal spray. However, the coating is not believed to have a lasting effect relative to the life of the footbed, in which case the improvement is generally incremental.

To address this, a number of attempts were implemented to provide ventilated footwear to enhance both comfort and to obviate the odors commonly associated with shoes and related footwear. However, foreign objects, water, dirt, and the like may enter the shoe through these ventilation openings. Shoes with pumps or air chambers to vent the inside of the shoe may overcome this disadvantage but such shoes are normally expensive or do not function properly due to complications in the pumps or chambers.

U.S. Pat. No. 4,015,347 to Morishita seems to relate to silver, other metals, and other additives applied to a footbed for killing germs, which may result in reduced odor and bacteria.

U.S. Pat. Nos. 2,482,333 to Everston, 4,727,661 to Kuhn, 4,967,750 to Cherniak, 5,961,544 to Goldman, 5,060,400 to Finn, 7,055,265 to Bathum, and 6,321,464 to Oberg patents appear to each relate to a removable footbed, where the footbed can be attached via snaps, buttons, hook and loop fasteners, and the like. Replacing footbeds typically reduce odor and bacteria. Finn further appears to disclose replacing one footbed with another footbed when the former becomes worn. Goldman also seems to relate to a grooved sole that locks the footbed in place. Bathum seems to further relate to a set of interchangeable footbeds where each insole is designed for a different activity.

U.S. Pat. No. 5,035,068 to Biasi patent often relates to a combination removable footbed with odor and/or antifungal additives.

U.S. Pat. No. 6,536,137 to Celia typically relates to a set of interchangeable footbeds where each footbed is different from a next footbed, and where each footbed is removably secured in the shoe via hook and loop fasteners. Celia also generally discloses additives that are added to the footbed, such as bactericides, absorptive fillers, fibrous materials, surfactants, odor absorbents, pH buffers, rubber particles, and thermal phase change particles.

However, none of these references effectively applies the additives over large parts of the interior for enhanced odor absorption and bacteria reduction, and where odor absorption and bacteria reduction are further improved by replaceable parts of the interior.

What is desired, therefore, is a shoe with a replaceable part. Another desire is where the replaceable part can be interchanged with a different replaceable part for varying comfort, odor absorption, moisture absorption, and the like. A further desire is a shoe with improved comfort, odor absorption, and moisture absorption throughout the interior of the shoe.

SUMMARY OF THE INVENTION

It is therefore an object of the invention to provide a shoe with replaceable footbeds, where each footbed has physical properties different from a next footbed and where each footbed removably placed within an interior of the shoe.

It is another object for a shoe to have additives dispersed throughout the interior of the shoe and footbeds.

A further object is a shoe having multiple additives dispersed throughout the interior of the shoe and footbeds, where each additive performs a different function.

These and other objects of the invention are achieved by a shoe having a sole attached to an upper for defining an interior, the interior having a recess, and at least two footbeds, each having different physical properties and each being sized to be placed within the recess. The shoe also has an additive dispersed over the interior and at least one footbed, wherein each of the at least two footbeds is removably placed within the recess depending upon a desired physical property.

In further embodiments, the shoe includes a plurality of footbeds, each having a different physical property than a next footbed. In other embodiments, the additive is selected from the group consisting of silver metal, silver chloride, super-absorbent, and combinations thereof.

In a more specific embodiment, the interior includes a front wall, at least a second recess in the front wall, and at least a second plurality of footbeds, each having different physical properties and each being sized to be placed within the at least second recess.

In some embodiments, the additive is dispersed over a part of the interior while the additive is dispersed over an entire interior in other embodiments. In some of these embodiments, there is at least a second additive, wherein the additive and the at least second additive are different metals.

In another aspect of the invention, the shoe includes at least one metal additive and at least one moisture absorbent additive dispersed over the interior and at least one footbed. In some of these embodiments, the shoe includes a moisture absorbing layer in at least one of the at least two footbeds.

In a more specific embodiment, the interior includes a side wall, a rear wall, and a front wall. In addition, the shoe includes a plurality of footbeds, each having a different physical properties; at least a second recess in the front wall, the rear wall, and the side wall; and at least a second plurality of footbeds for placement in the at least second recess, each having different physical properties and each being sized to be placed within the at least second recess.

In another aspect of the invention, a method of providing a shoe includes the steps of attaching a sole to an upper for defining an interior, placing a recess in the interior, and removably placing one of at least two footbeds in the recess, each footbed having different physical properties from one another and each being sized to be placed within the recess. The method also disperses at least one metal additive and at least one moisture absorbent additive over the interior and at least one footbed, wherein each of the at least two footbeds is selected for placement within the recess based upon a desired physical property.

In some embodiments, the method includes a moisture absorbing layer. In further embodiments, the method includes the step of providing a plurality of footbeds, each having different physical properties; placing at least a second recess in the interior; and removably placing one of at least a second plurality of footbeds in the at least second recess, each having different physical properties and each being sized to be placed within the at least second recess.

BRIEF DESCRIPTION OF THE DRAWINGS

FIG. 9 shows a perspective view partly broken away showing a two-layered composite material in accordance with the present invention, in the form of an insole, FIG. 10 is an enlarged diagrammatic sketch showing in cross-section the cover layer, the foam layer and the third layer of non-woven fiber web of thermoformable material of the composite material shown in FIG. 1, connected by an adhesive bonding material, FIG. 10A is an enlarged fragmentary view showing a highly compressed fragment of the bottom or second layer of material shown in FIG. 3 in which all the interstices within the non-woven material are filled with the hydrophilic foam;

FIG. 10B is an enlarged fragmentary view showing the fibers when not under high compression in the three-layered composite material shown, in which the interstices of the non-woven material are not filled, in accordance with one embodiment of the present invention, FIG. 10C is an enlarged view of the foam-encased fibers, shown in FIG. 10B.

DETAILED DESCRIPTION

Figure 1:
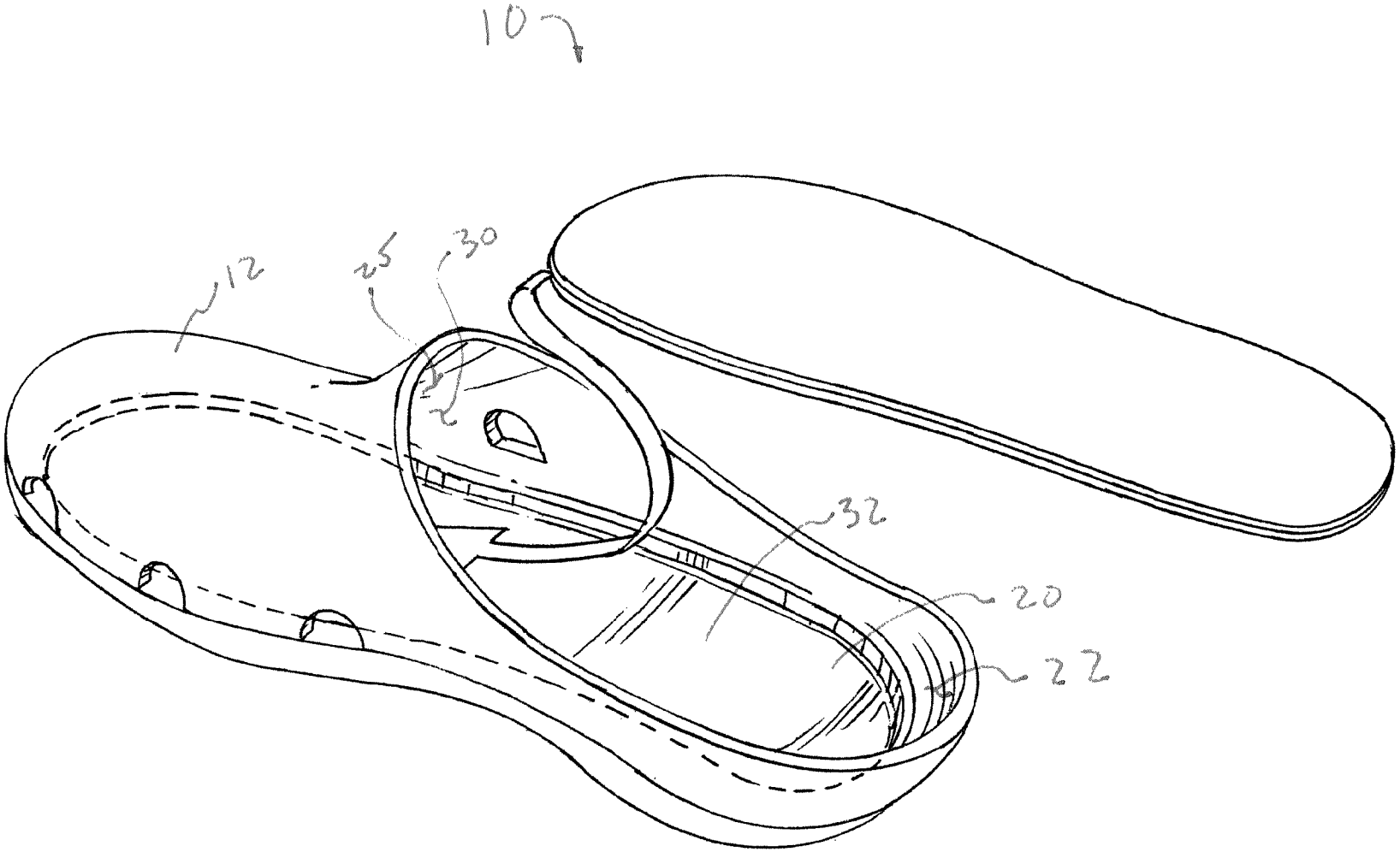
FIG. 1 depicts the shoe in accordance with the invention.
Figure 2:
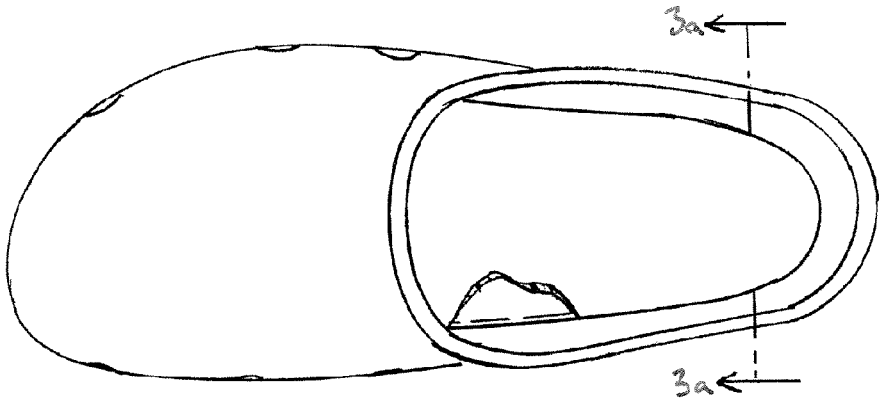
FIG. 2 depicts a top view of the shoe shown in FIG. 1.
Figure 3A:
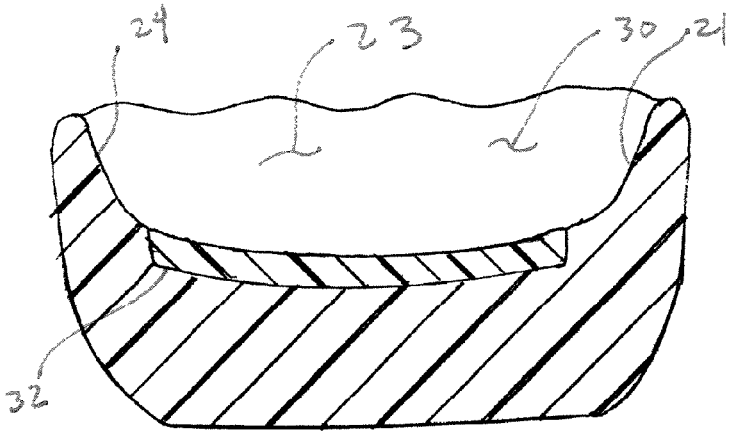
FIGS. 3*a*-3*b* depict cross sectional views of the shoe shown in FIG. 1.
Figure 3B:
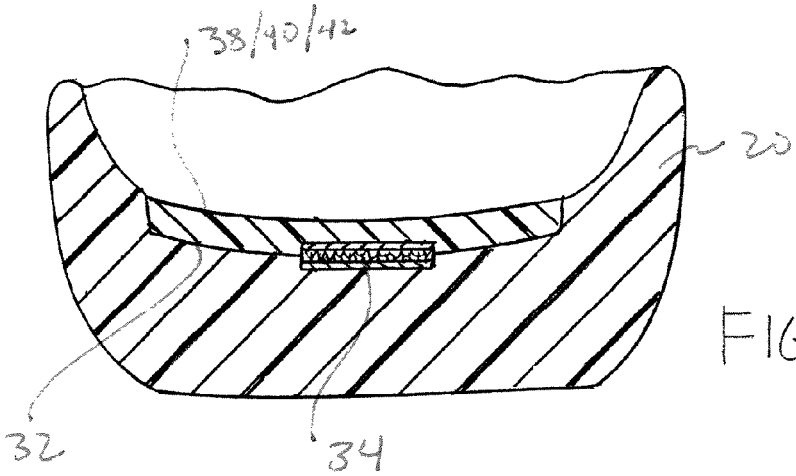
Figure 4:
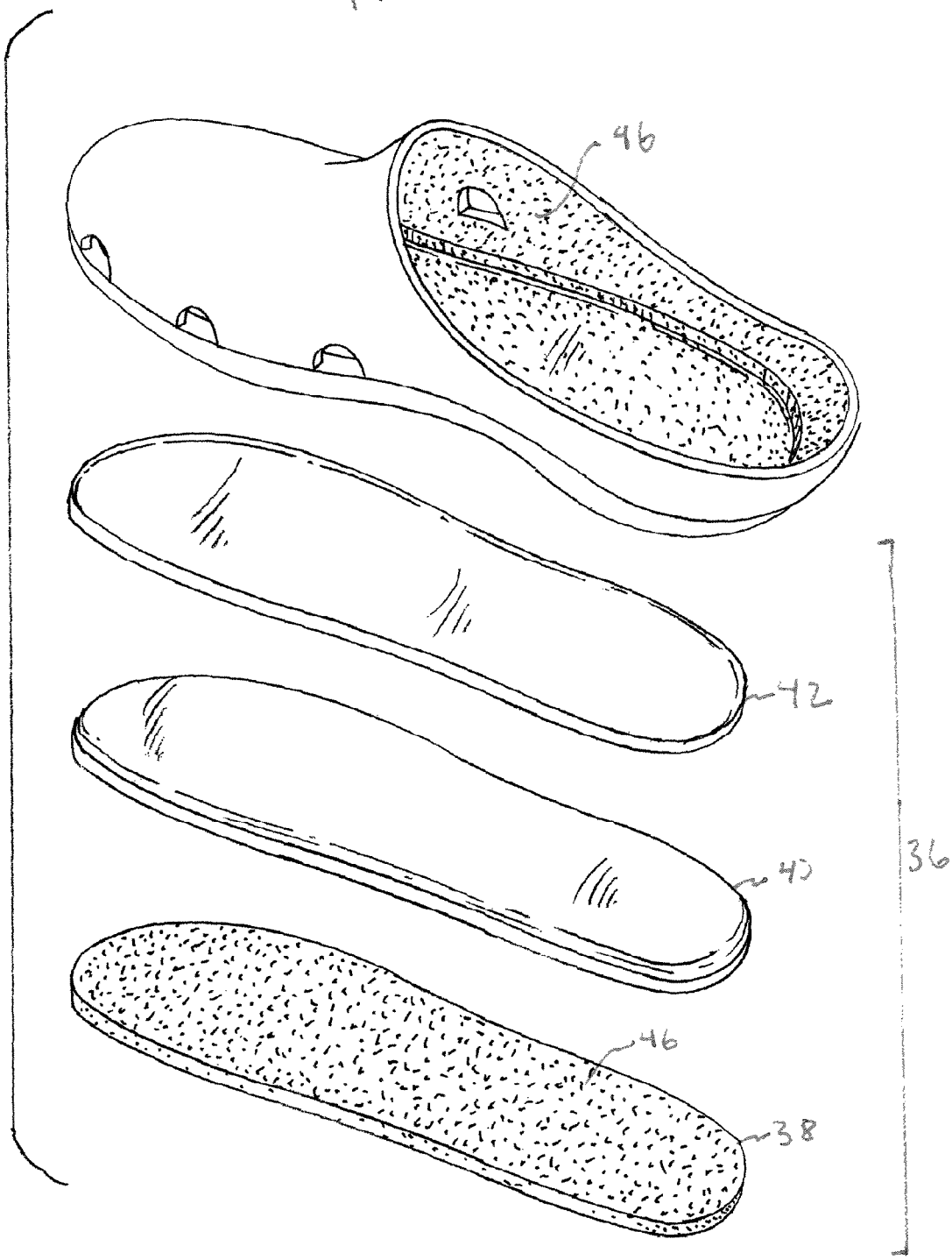
FIG. 4 depicts an assembly view of the shoe shown in FIG. 1.

FIG. 1 depicts shoe 10 in accordance with the invention, including upper 12 being attached to sole 20 for defining interior 30 of the shoe. Interior 30 has recess 32 (see FIGS. 3*a*-3*b*) for placement of one of plurality 36 of footbeds (see FIG. 5). As shown in FIG. 4, plurality 36 of footbeds comprise at least first 38 and second 40 footbeds. Although third 42 footbed, for a total of three footbeds, is shown, any number of footbeds greater than two are envisioned.

First 38 footbed has a different physical characteristic than second 40 footbed. As shown, first 38 footbed has additives 46 applied to its surface for assisting in reducing germs and/or odors and second 40 footbed has enhanced cushioning. Third 42 footbed has a thinner cushion when compared to second 40 footbed.

A user selects which footbed out of plurality 36 of footbeds for placement in recess 32 based on the physical characteristic unique to each footbed. Once selected, the user places the selected footbed in recess 32 and the selected footbed is securely held due to an interference fit between a perimeter of the footbed and perimeter of recess 32, where the perimeter of recess 32 is approximately the same or less than the perimeter of the footbed.

It is understood that the physical properties of first, second, and third footbeds described above are not the only properties available to the footbeds. In other embodiments, at least one of the footbeds is stiffer for rugged conditions, such as hiking. In further embodiments, at least one of the footbeds is are brittle, an orthodic that guides the foot while walking.

Figure 5:
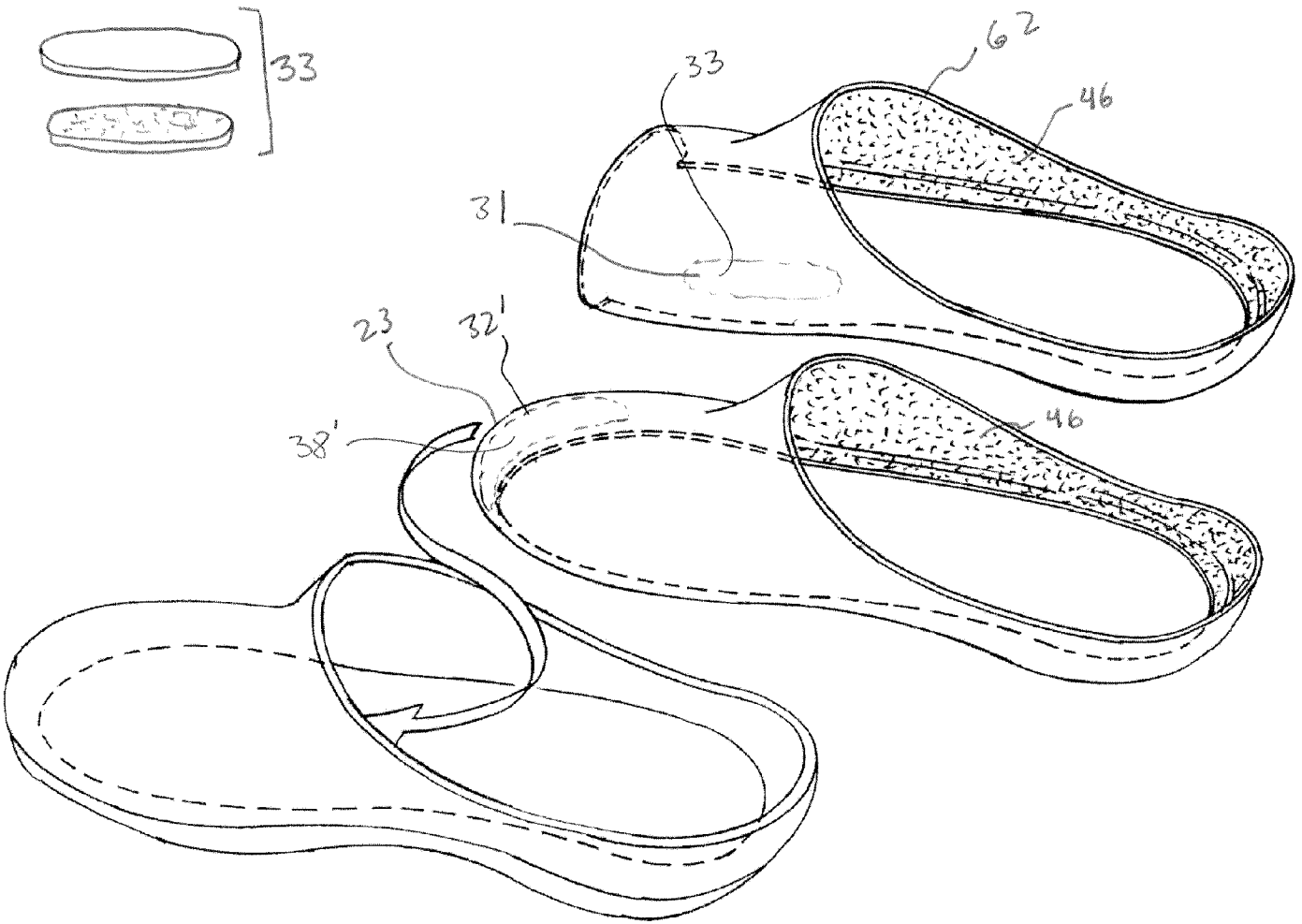
FIG. 5 depicts an exploded view of another embodiment of the shoe shown in FIG. 1.

As shown, recess 32 is placed at a bottom of interior 30. Interior 30 is defined to be any part of the inside of shoe 10, including right side wall 21, back wall 22, front wall 23 (toe area), left side wall 24, and tongue area 25. In another embodiment, as shown in FIG. 5, recess 32' is placed in front wall 23 where footbed 38' is placed. As shown in FIGS. 1 and 5, recess 32' and footbed 38' are placed in various parts of interior 30 and other embodiments they are placed in other parts of interior 30. In these efforts, interior 30 has reduced odor and/or bacteria since more parts of interior 30 are interchangeable. Moreover, the newness and fit of shoe 10 is enhanced since any part of interior 30 that is worn can be replaced with a new part.

In addition to the foregoing, the sizes and shapes of each footbed shown should not be interpreted to be limitations of the invention. Other embodiments have footbeds that conform to interior 30. Further embodiments have footbeds that conform to a shape of a foot.

In another embodiment of recess 32, fastener 34 is placed within recess 32 for securing the selected footbed in recess 32. As shown, a hook and loop fastener is employed but any other fastener is acceptable so long as it helps prevent accidental dislodging of the selected footbed, such as buttons, adhesive, screws, and the like.

Figure 6:
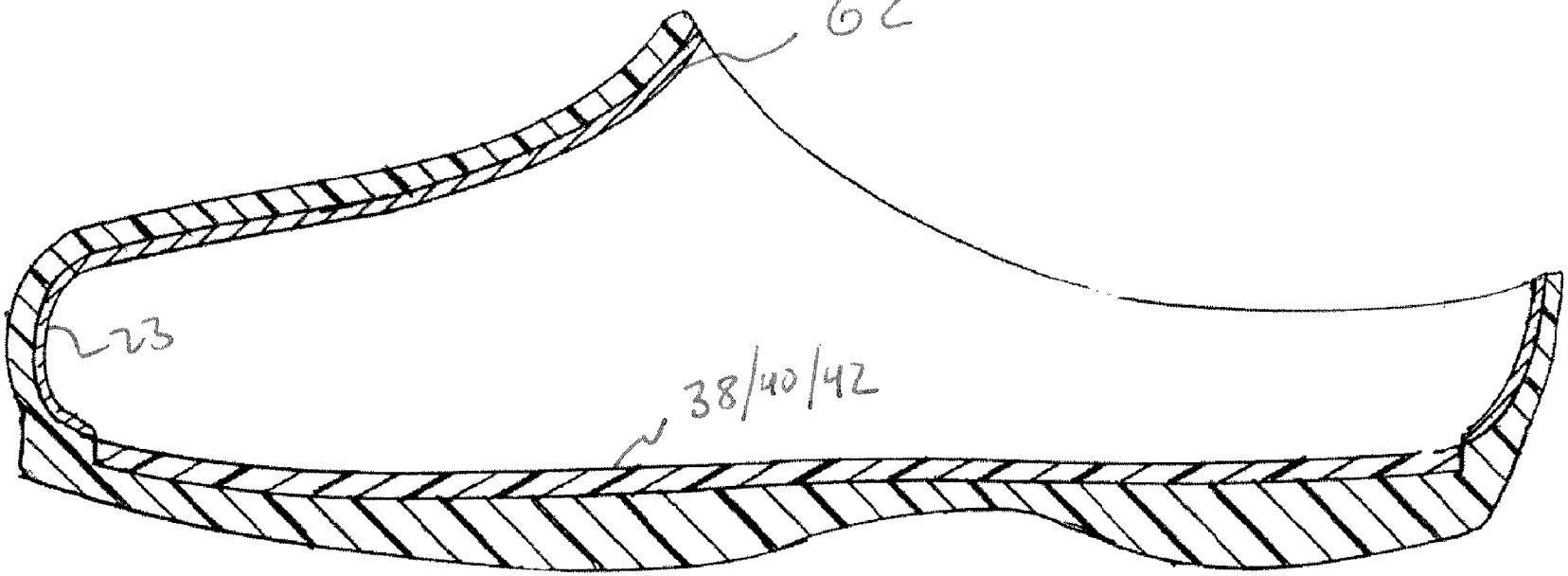
FIG. 6 depicts a cross sectional shoe shown in FIG. 5.

As shown in FIG. 4, additives 46 are dispersed throughout interior 30 of the shoe, including footbed 38, right side wall 21, back wall 22, front wall 23, and left side wall 24. More particular, additives 46 are applied to a layer of hydrophilic foam and such is then secured to right side wall 21, back wall 22, front wall 23, left side wall 24, and tongue area 25 (see bootie 62 of FIGS. 5-6). In other embodiments, additives 46 are dispersed over right side wall 21, back wall 22, front wall 23, and left side wall 24 in the same manner as additives 46 are applied to first footbed 38. In a further embodiment, additives 46 are dispersed over any combination of these walls, whether all four of them or some of them so that part or all of interior 30 is covered.

In some of these embodiments, at least second 31 recess is placed in right side wall 21, back wall 22, front wall 23, left side wall 24, and tongue area 25 and at least second 33 plurality of footbeds are provided, each of which is removably placeable within said at least second 31 recess.

Since second 31 recess differs in size and shape from recess 32, second 33 plurality of footbeds differs from plurality 36 of footbeds but the material for, securement of, and additives applied to second 33 plurality of footbeds include the same limitations as plurality 36 of footbeds. In further embodiments, since second 33 plurality of footbeds are not placed under a user's foot, they are renamed to be cushions.

In other embodiments, second 31 recess is replaced by interchangeable parts of bootie 62 (see FIG. 5). This embodiment is beneficial in that bootie 62, or layer of foam, is generally thin and not thick enough to place second 31 recess in the layer of foam. Therefore, bootie 62 and interchangeable parts achieve the same purpose.

As shown, toe area 23, or front wall is replaceable with other toe areas to accomplish the same goal as plurality 36 of footbeds, where each toe of plurality of toe areas have different physical properties.

In some embodiments, the benefits and limitations of plurality 36 of footbeds are included in the plurality of toe areas. In some of these embodiments, lining 62 is applied to any part of interior 30, particularly the areas prone to odor and/or bacteria absorption. As shown in FIG. 5, lining 62 is adhered to interior 30. In another embodiment, lining 62 is attached to toe area 23, which is prone to odor and/or bacteria absorption.

In a further embodiment, lining 62 is removable from interior 30 to provide the same advantages as each of plurality 36 of footbeds, where lining 62 is interchangeable with other linings. An adhesive or fastener secures lining 62 to interior 30.

In another embodiment, a plurality of linings are provided where each lining has a different characteristic than a next lining. All of the limitations and advantages applicable to plurality 36 of footbeds are applicable to the plurality of linings, such as bactericides and other additives being applied to lining 62.

Additives are defined to include bactericides, such as silver in an amount of approximately 0.1% to approximately 20% by weight. In some embodiments, the silver is in the form of a flake. In other embodiments, the silver is a nano size particle. In further embodiments, the silver is coated onto nylon fibers, where the larger fibers have more silver and, therefore, more ion releases than smaller cuts of silver.

In additional embodiments, the additive is silver chloride, which yields a preferred concentration of silver ions in would fluids with a reduced likelihood of toxicity. When in an aqueous medium, such as a wound fluid, a silver compound will typically dissociate into silver ions ($Ag^+$) and its counterion, such as a chloride ion ($Cl^-$). Some silver compounds, especially highly soluble ones like silver nitrate, will produce a huge and possibly toxic concentration of the silver ion upon dissolution in wound fluids or aqueous mediums. Others, such as the silver chloride compound, will form just the right concentration of silver ions in wound fluids or aqueous mediums, making this form suitable for a wound environment because it is non-toxic, yet lethal to microorganisms.

Silver metal is extremely stable but under certain conditions will undergo a transition to its ionic form ($Ag^+$), which is highly reactive. In other words, the ionic form wants to bind with something that has a negative charge. When it reacts, a compound is formed. So, silver can exist in three states: as a metal, as a compound and as a free dissolved ionic form.

In some embodiments, an amount of silver greater than approximately 20% by weight proves to be too toxic to a wearer, where the wearer can become ill. In other embodiments, less than approximately 0.1% proves to be ineffective to reducing odor and/or germs.

Referring to the FIGS. 7, 8, 8A and 8B, a footbed is shown. It is understood the footbed shown in these figures is either first 38 footbed, second 40 footbed, third 42 footbed, or any one or more of plurality 36 of footbeds, regardless of how many footbeds there are. Therefore, for simplicity, the footbed will be described generally knowing the limitations may be included in any of plurality 36 of footbeds.

As shown, the footbed comprises a two-layered form of the composite material generally designated 100 in the form of an insole for a shoe having a cover layer 111 and a foam layer 112 that is hydrophilic with respect to the cover layer 111, which is operatively joined or connected or bonded or otherwise laminated in any suitable way to the cover layer 111 as by needle punching, so that the composite material acts to draw or transfer moisture or bodily fluids from and through the cover layer 111 into the foam layer 112 which acts as a reservoir, to absorb, gel or store and dissipate such moisture or bodily fluid as by evaporation from or by washing of the composite material. After the moisture or bodily fluid is dissipated, from time to time, the composite material can be reused. However, those skilled in the art will recognize that the composite materials formed in accordance with the present invention can also be made of materials so that the composite material can also be disposable rather than reusable.

The foam layer 112 may be first formed by polymerizing an aqueous mixture, having as its principal component one or more sorbents with or without various additives, with a predetermined quantity of a hydrophilic urethane prepolymer binder so that the polymerization of the polyurethane foam forms a matrix binder for the one or more sorbents. While the sorbents have been referred to as the principal component, it will be readily understood by those skilled in the art that the aqueous mixture may consist of various combinations of other components without departing from the scope of the present invention including absorptive fillers, fibrous materials, including non-woven fiber materials, surfactants, thermoformable acrylic latex emulsions, odor absorbents and bactericides, such as the various silver described above. Further and additional components may include citric acid, rubber particles and thermal phase change particles depending on certain advantageous and desirable characteristics or functions to be achieved by the composite material.

The characteristics of the sorbent component may be selected so that the volume, rate of absorption and the retention or gelling of the moisture absorbed under varying ambient conditions of temperature and pressure may be optimized for a given composite material being formed. Preferred sorbents adapted for use in the aqueous mixture are primarily super absorbent polymers available in the commercial marketplace as SAB 800 from STOCKHAUSEN, Greensboro, N.C. 27406; as SANWET IM 1000 from Hoechst Celanese Corporation, Portsmouth Va. 23703; as ARIDAL 1460 from Chendal Corporation, Palatine, Ill. 60067; and as ARASORB 800F from Arakawa Chemical Industries, Limited, Osaka 541, Japan.

These sodium polyacrylate/polyalcohol polymer and copolymer sorbents are manufactured and sold in free-flowing, discrete solid particles, in powder or granular form, and are characterized by the fact that they have a propensity for absorbing increasing quantities of aqueous fluid. This would normally lead to the complete solution of the polymers into the aqueous mixture. However, due to the chemical characteristics of the polymers and co-polymers, the formation of a gel takes place precluding the solution of the polymer or co-polymers. Other sorbents including polyethylene oxide, sodium carboxymethyl cellulose, and like polymers, desiccants such as silica gel, clays such as bentonite, and the like may be used as well.

Figure 8:
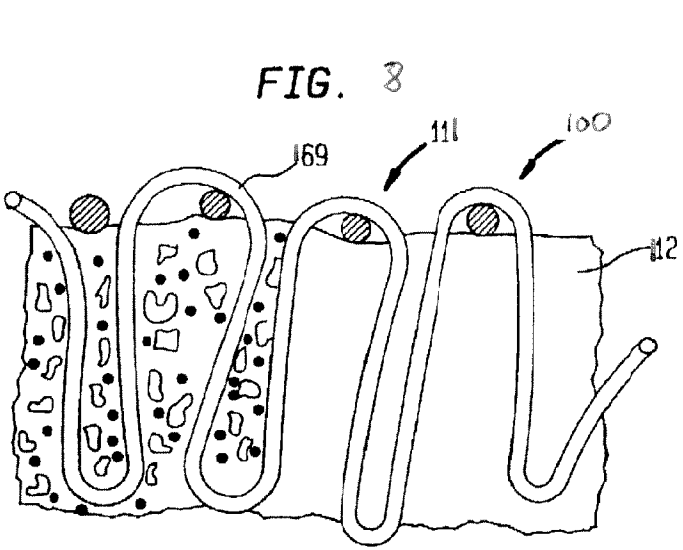
FIG. 8 is an enlarged diagrammatic sketch showing in cross-section the elements of the base layer, connected to the cover layer of the composite material, shown in FIG. 1, by needle punching.
Figure 8B:
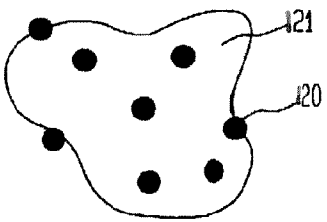
FIG. 8B is an enlarged fragmentary cross-section taken on line 3A-3A of FIG. 2.
Figure 8A:
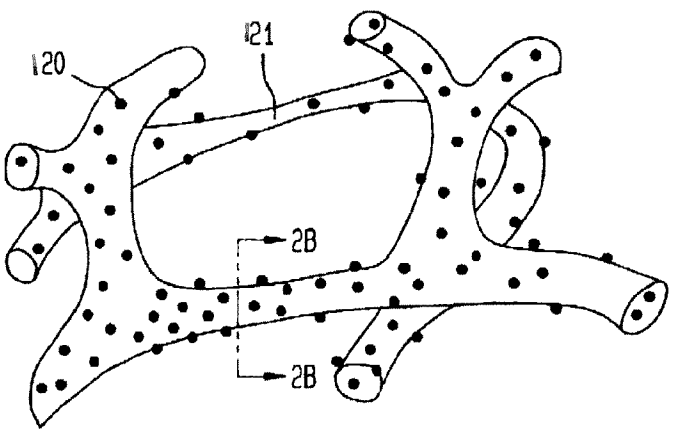
FIG. 8A is an enlarged fragmentary view showing a section of the foam layer of the composite material shown in FIG. 1.

Thus, when an aqueous mixture is metered and mixed with a hydrophilic urethane prepolymer, as more fully described below, the urethane prepolymer reacts with the water in the aqueous mixture to form a hydrophilic polyurethane foam, and at the same time, as shown in FIGS. 8A and 8B, when a sodium polyacrylate sorbent 120 is present, the urethane prepolymer reacts with the sorbent to form a hydrophilic acrylic urethane interpolymer 121.

The combination of the sorbent with the hydrophilic foam thus formed acts in composite materials of either two larger or multiple layers to absorb, adsorb and gel the moisture drawn through the cover layer and to contain and store it so as not to rewet the cover top layer of the layered composite material. The sorbents thus add hydrophilicity to the foam layer of the composite materials.

The additives which may be combined in the aqueous mixture with the sorbents are also available in the commercial marketplace.

Thermoformable acrylic latex emulsions are available from Union Carbide Corporation of New York, N.Y., Rohm & Haas, B.F. Goodrich and others. One preferred form of acrylic emulsion is available from Union Carbide under the trademark "UCAR 154". As is well known to those or ordinary skill in the art, latex emulsions are surfactant-stabilized polymer emulsions, and are commonly used as binders for non-woven materials. The thermoformable latexes form thermoplastic polymer films that are capable of being formed or molded when the film is heated above the glass transition temperature of the polymer.

Use of acrylic latex emulsions in the foam layer of the present invention thus serves as an alternative to the three-layer composite materials of the present invention wherein the third layer is a thermoformable non-woven material bonded to the side of the foam layer remote from the cover layer. The thermoformable acrylic latex emulsions are incorporated into the foam layer by including the emulsion as part of the aqueous mixture reacted with the hydrophilic urethane prepolymer. The water content of the emulsion reacts with the hydrophilic urethane prepolymer to form the polyurethane foam when the aqueous mixture and the urethane prepolymer are reacted together. Thus, the water content of the emulsion should be included as part of the water content of the aqueous mixture when calculating the ratio of the aqueous mixture to be reacted with the urethane prepolymer. Those of ordinary skill in the art will understand that the acrylate component contributed by the thermoformable acrylic latex emulsion is discrete and separate from the acrylate component contributed by the sodium polyacrylic sorbent, when present.

When the foam polymerization is complete, residual water is driven off by drying the foam at a temperature of about 200.degree. F. After bonding of the foam layer to cover layer, the thermoformable acrylic latex, when present, permits the forming or molding of the composite by heating the composite in a mold or other form at a temperature above the glass transition temperature of the acrylic latex, typically a temperature of about 270.degree. F., after which the composite is cooled and removed from the mold or form.

Surfactants useful in the combinations in accordance with the present invention are prepared from nonionic polyethylene and polypropylene oxides such as the BASF surfactant available under the trademark "PLURONIC".

Odor absorption materials are also well known to those skilled in the art and include, activated carbon, green tea, "ABSENT" (UOP); zinc oxide and the like materials.

Bactericides are provided in the commercial marketplace by a myriad of suppliers for controlling bacterial and germ growth. One preferred material is supplied by Lauricidin Co. of Galena, Ill. 61036, under the trademark "LAURICIDIN".

Phase change materials are capable of absorbing approximately 100 BTU/lb. These materials are described in prior art U.S. Pat. Nos. 4,756,958 and 5,254,380.

Other components may be added to the aqueous mixtures, such as citric acid as a buffer for reducing the pH of the water component to increase loading of the sorbent and the fluid characteristic of the aqueous mixture to facilitate pumping of the aqueous mixture; and ground rubber particles from tires available from Composite Particles of Allentown, Pa. increase the resiliency and thermal protection of the composite material. These will be illustrated in the examples of the aqueous mixture more fully set forth below.

The hydrophilic urethane prepolymer component is also available in the commercial marketplace. Suitable prepolymers will be readily recognized by those of ordinary skill in the art and are described in prior art U.S. Pat. Nos. 4,137,200; 4,209,605; 3,805,532; 2,993,013 and general procedures for the preparation and formation of such prepolymers can be found in Polyurethane's, Chemistry and Technology by J. H. Saunders and K. C. Frisch published by John Wiley & Sons, New York, N.Y., at Vol. XVI Part 2, High Polymer Series, "Foam Systems", pages 7-26, and "Procedures for the Preparation of Polymers", pages 26 et seq.

One preferred form of such prepolymer adapted for use in the present invention because of its strong hydrophilic characteristics and its reasonable price is marketed by Matrix R & D of Dover, N.H. as TDI/PEG Urethane Prepolymer under the trademark "BIPOL". These products are polyether urethane polymers of toluene disocyanate terminated polyethylene glycol with less than six percent (6%) available unreacted NCO groups and a component functionality of two (2) or less.

Another urethane prepolymer is available from W. R. Grace Company of New York, N.Y. sold under the trademark "HYPOL 3000". This "HYPOL" urethane prepolymer is a polyisocyanate capped polyoxylene polyol prepolymer having a component functionality greater than two (2). However, this prepolymer is formulated with a triol which reduces its hydrophilic capability. Therefore this "HYPOL" urethane prepolymer is less acceptable for the formation of the base layer of the composite material.

Figure 7:
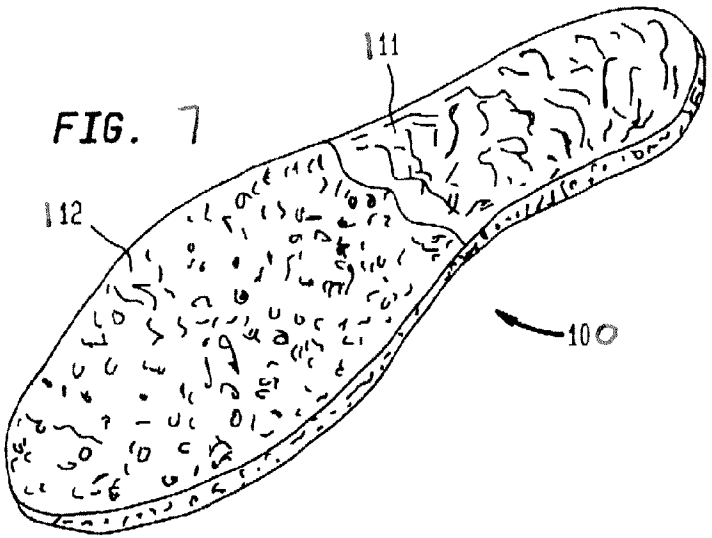
FIG. 7 shows a perspective view partly broken away showing a two-layered composite material in accordance with the present invention, in the form of an insole.

When the hydrophilic urethane prepolymer is added in precise amounts to the aqueous mixture, in addition to controlling the absorption characteristics of the final composite material, it has been found that it enhances the composite material so it can be sized and thermoformed into three-dimensional shapes such as the insole for shoes as shown in FIG. 7 of the drawings.

Thus, in the formation of the foam layer, a given aqueous mixture will be blended in ratios of 2 to 10 parts by weight of the aqueous mixture to 1 part by weight of the hydrophilic urethane prepolymer. Controlling in precise amounts the relative ratio of the aqueous mixture to the hydrophilic acrylic urethane prepolymer within these limits does not impair the capabilities of the super-absorbent polymer for absorbing and gelling moisture and body fluids with which the composite material comes into contact.

Another form of the composite material 100 in accordance with the present invention is shown in FIGS. 9 and 10 in which the cover layer 111, foam layer 112 hydrophilic with respect to the cover layer 111 and a bottom or third layer 113 in the form of a non-woven fiber web or felted non-woven fiber web material. In this form of the composite material, depicted in FIGS. 9, 10, 10A, 10B and 10C, the non-woven fibers selected are preferably those having stiffening or thermoforming capabilities.

Non-woven webs of fibrous materials for this purpose are available in the commercial marketplace as polyester non-woven fibers coated with acrylic resin from Union Wadding of Pawtucket, R. I.; Carr Lee of Rockleigh, N.J.; Stearns Kem Wove of Charlotte, N.C.; and Loren Products of Lawrence, Mass. Such polyester non-woven webs of fibrous material are used in the present invention because of their durability, adhesion to the components of the respective aqueous mixtures, because they act to reduce shrinkage during the secondary drying steps in the formation of the foam layer 112 for the composite material being formed as is hereinafter described and because of the increase tensile strength they impart to thin films of the composite material, in accordance with the present invention, as those used in apparel and other products. Union Wadding supplies such preferred non-woven fibrous webs at 1½ to 3 ounces per yard (¼" to ½" thickness). These are polyester 3 and 6 denier fiber acrylic spray bonded thermoformable materials. These products are formulated to enhance thermoformability of the multi-layered composite material.

Similarly felted non-woven webs of fibrous material are also available in the commercial marketplace from Non Wovens Inc. of North Chelmsford, Mass., who supply their products 8 oz. per square yard, 0.080 thickness, 65% low melt polyester and 35% high melt polyester. These felted non-woven webs of fiber material provide the same improved characteristics to the foam layer 112 of the composite material 100 in accordance with the present invention as has been above described.

It should be noted that non-woven materials may also be introduced as a component of the polyurethane foam layer, rather than being bonded to the foam layer as a discrete third layer. The addition of the non-woven material within the foam layer adds strength, minimizes shrinkage in drying and acts as a wick for moisture transpiration into the foam layer. Such foam layers are formed by depositing the polymerizing foam onto a non-woven fiber web and compressing the foam-coated web to 10% of its thickness, thus coating the fibers of the web with the polymerized foam containing interstitial voids.

The Method of Making the Composite Material.

The formation of these alternate types of composite material in accordance with the present invention is done on generally state of the art equipment, and this is illustrated by the diagrammatic sketches shown in FIGS. 11, 11A, 12 and 13 of the drawings.

Figure 11A:
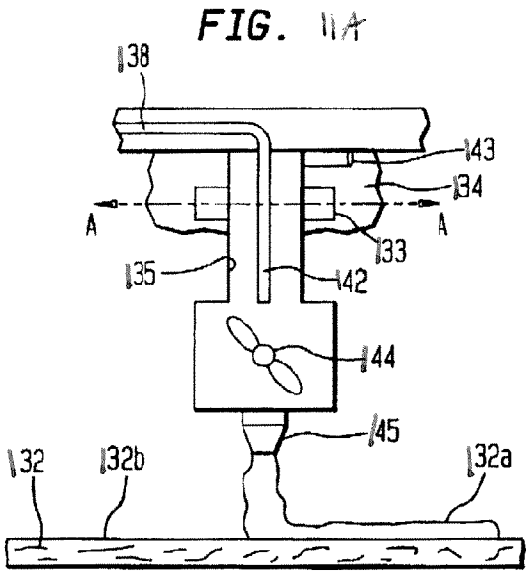
FIG. 11A is an enlarged view of the metering, mixing and dispensing chamber shown in the apparatus in FIG. 5.
Figure 11:
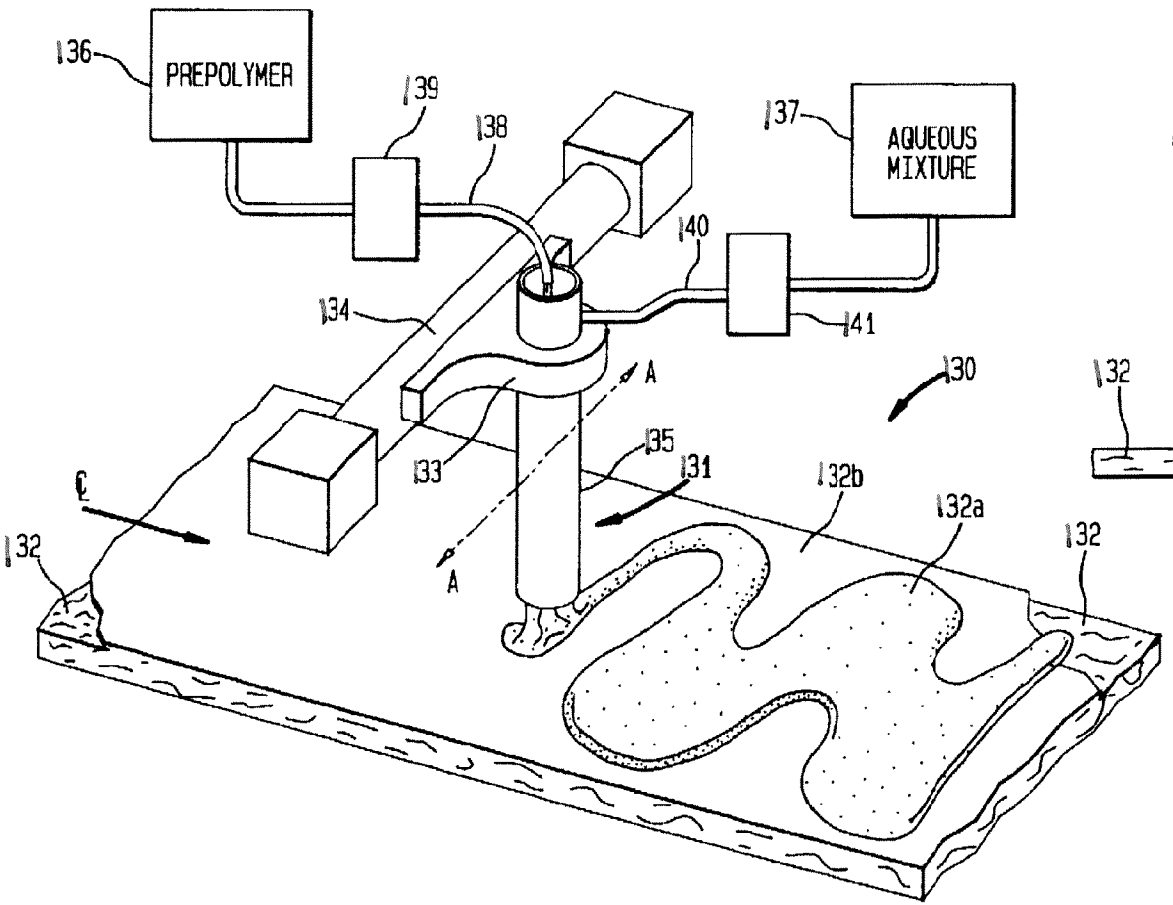
FIG. 11 is a diagrammatic sketch of the section of a conveyor apparatus for metering and mixing in a predetermined ratio a given aqueous mixture having a sorbent and an acrylic latex emulsion with a hydrophilic urethane prepolymer and for dispensing the combined mixture on a movable carrier means for forming the foam layer of the composite material.

Thus, in the diagrammatic sketches at FIGS. 11 and 11A, the first section of the equipment or apparatus generally designated 130, is shown as having a metering, mixing and dispensing unit generally designated 131, disposed to move transversely, as shown by the directional arrow A-A, to the longitudinal line of movement of an endless conveying belt or carrier 132, for depositing blended and mixed combinations of the aqueous mixtures and hydrophilic urethane prepolymer as at 132*a* on a releasable paper 132*b* positioned on the conveying belt 132 where further polymerization will then occur.

Metering, mixing and dispensing unit 131 is shown as including, housing 133 which is mounted for movement to and fro along carrying beam 134 and defines a blending and mixing chamber 135. A first mixing vessel 136 is provided for the hydrophilic urethane prepolymer. A second mixing vessel 137 is provided for forming and holding any one of the combinations of the aqueous mixtures, examples of which are hereinafter described.

First mixing vessel 136 is so connected by a first pipe line 138 to the housing 133 that it communicates with the blending and mixing chamber 135 defined by the housing 133. A first pump 139 in first pipe line 138 acts to pump metered quantities of a fluid mixture of the hydrophilic urethane prepolymer from the first mixing vessel 136 to the blending and mixing chamber 135 in the housing 133. Similarly, the second mixing vessel 137 is so connected by a second pipeline 140 to the housing 133 that a second pump 141 in the second line 140 can pump metered quantities of the given combination of the aqueous mixture to the blending and mixing chamber 135 in the housing 133.

First pump 139 and second pump 141 are metering pumps so that the respective volumes by weight of the given aqueous mixture and hydrophilic urethane prepolymer in the desired ratios will be delivered to the blending and mixing chamber 135.

The delivery section 142 of the first pipeline 138 is disposed to deliver the hydrophilic urethane polymer into the central portion of the blending and mixing chamber 135 while the delivery section 143 for the second pipeline 140 is connected so that the given combination of the aqueous mixture is delivered tangentially about the centrally disposed delivery section 142 of the first pipeline 138, to enable the respective components of the foam hydrophilic layer 112 of the composite material being formed, to be intimately mixed by any suitable mixing device or rotor as at 144 in the blending and mixing chamber 135 formed by the housing 133, all of which is shown by FIGS. 11 and 11A of the drawings.

FIG. 11A further shows that the housing 133 has a dispensing head or nozzle 145 on the end of the housing 133 adjacent to the upper surface of the conveyor belt or carrier 132 and so communicates with the blending and mixing chamber 135 that during operation of the apparatus the nozzle 145 will deliver the blended and mixed combination of the given aqueous mixture and hydrophilic urethane prepolymer generally designated 132*a* onto the moving upper surface of the bottom release paper 132*b* positioned on the conveyor belt 132 on carrier 132, all of which is shown by FIGS. 11, 11A, 12 and 13 of the drawings.

Figure 12:
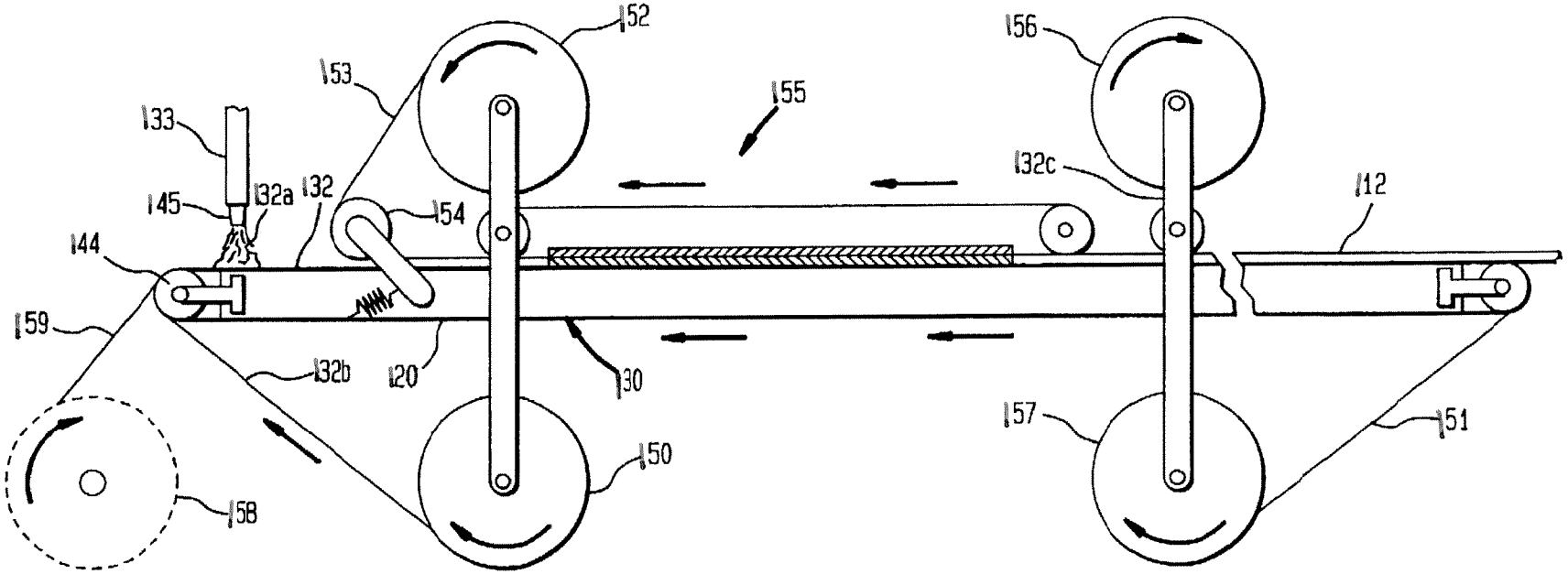
FIG. 12 is a further diagrammatic sketch of a another section of the apparatus for forming the foam layer for the composite material.

FIG. 12 shows another section of the conveying belt system 130 having, a roll 150 of silicone or the like type of bottom release paper 132*b* which is first delivered from the roll 150 to a position on the upper surface of the conveyor belt 132 at the point where the dispensing head or nozzle 145 delivers the given combined mixture 132*a* as above described. This polymerizing combined mixture 132*a* thus is cast in a sinusoidal path because of the transverse movement of the mixing, blending and dispensing head 133, onto the bottom release paper 132*b*. Mixture 132*a*, and the bottom release paper 132*b* will move and advance with the conveyor belt 132 to a point where a roll 152 of similar silicone or top release paper 132*c* covers the combined polymerizing mixture 132*a* as it passes under a preliminary adjustable sizing roller 154 to bring the combined polymerizing mixture 132*a* to an initial thickness.

On further advancing movement of conveyor belt 132 the combined polymerizing mixture 132*a* disposed between the bottom release paper 132*b* and top release paper 132*c* is now moved into a compression mechanism generally designated 155 where further sizing of the combined polymerizing mixture 132*a* to the desired thickness is established depending on the ultimate use of the composite material to be formed into components to be stamped or to be cut from the composite material.

When the combined polymerizing mixture 132*a* emerges from the compression mechanism 155, it will be for all purposes self-sustaining and the top release paper 132*c* is stripped off by first stripping roller 156, while the generally now self-sustaining foam layer 136*a* on the bottom release paper 132*b* continues with the advancing movement of the conveyor belt 132 until the end of the conveyor belt 132 is reached, at which time the bottom release paper 132*b* is then also stripped off by second stripping roller 157, all of which is shown by FIG. 12 of the drawings.

Thus, as shown in FIGS. 11, 11A and 12 and as above described, the polymerizing combined mixture 132*a* is discharged from the dispensing nozzle 145 directly onto the upper surface of the bottom release paper 132*b* to provide the sheet stock form of the foam layer 112 for the composite material 100.

Apparatus of this type, as well as the controls for establishing the operation of the conveyor belt and the delivery of the combined mixture by the dispensing head or nozzle, is generally well known to those skilled in the art and therefore has not been more fully described.

After the blended combination of the aqueous mixture and the hydrophilic urethane prepolymer 146 is deposited as above described on the conveyor belt 132 as the belt moves along, this polymerizing mixture is then further treated to provide one layer 112 of the composite material in accordance with the present invention.

The respective combinations of the given aqueous mixture and predetermined quantity of hydrophilic urethane prepolymer may take a variety of forms and will be transported by the conveyor belt 132 until the polymerizing given combined mixture has been shaped, sized and become the self-sustaining foam layer 112 and is ready to be united or connected to the cover layer 111 to form the composite material 100.

Figure 13:
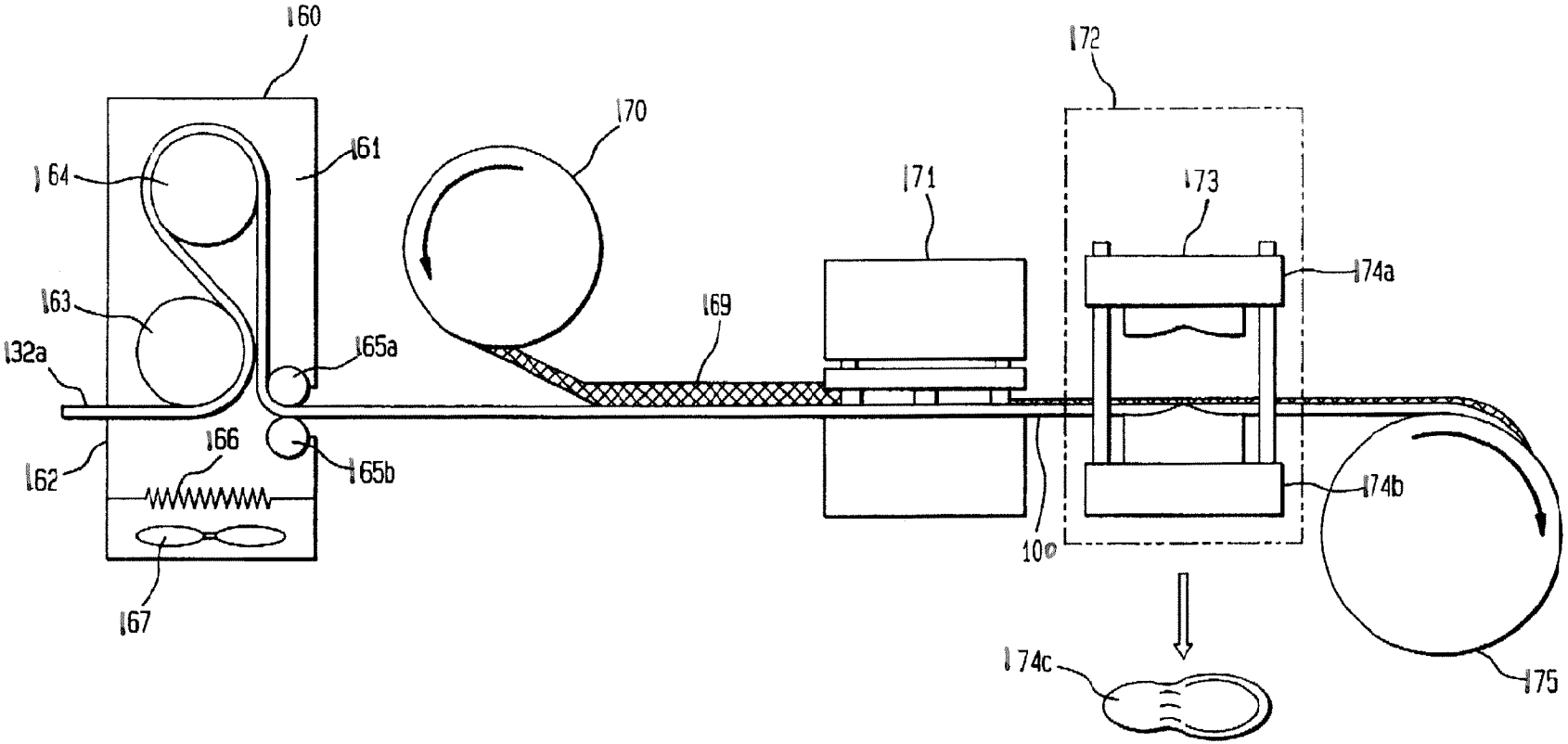
FIG. 13 is a further diagrammatic sketch of another section of the apparatus showing how the composite material is formed and includes a step for needle punching, thermoforming and for cutting insoles for shoes out of the formed composite material.

In order to complete the formation of the two-layered composite material, FIG. 13 shows in a further section of the apparatus that the generally self-sustaining combined mixture forming the foam layer 136*a* is now passed into and through any suitable form of drying unit generally designated 160 to remove substantially all of the remaining moisture to then provide the foam layer 112 for joinder and connection with the cover layer 111 to form the composite material 100.

Drying units such as the drying unit 160 shown in FIG. 13 are well known devices and include generally a drying space 161 into which the self-sustaining combined mixture forming the hydrophilic foam layer 136*a* is introduced through entrance opening 162 where it passes over idling rollers as at 163, 164 and co-acting driving rollers as at 165*a* and 165*b* so that heated air at a temperature below 260.degree. F. from the heating means 166 can be blown by fan means 167 through the drying space 161 to pass over the moving generally self-sustaining hydrophilic foam layer 136*a* to substantially remove all the remaining moisture from the hydrophilic foam layer 112. Foam layer 112 is then advanced by the driving rollers 165*a* and 165*b* through an exit outlet 168 to the secondary or finishing steps for the formation of the two-layered composite material 100.

As shown in FIG. 13, as the hydrophilic foam layer 112 is now further advanced, randomly oriented three denier acrylic fibers 169, approximately three (3) inches long, are dispensed from a roll 170 and laid onto the upper surface of the moving hydrophilic foam layer 112 at about three (3) ounces of fiber per square foot to position a cover layer 111 on the upper surface of hydrophilic foam layer 112. The composite material can now be formed by joining this cover layer 111 to the hydrophilic foam layer 112 by any suitable means such as passing the cover layer 111 and hydrophilic foam layer 112 through a needle punching station generally designated 171 where they are mechanically joined.

Needle punching machines are well known in the art. In the diagrammatically illustrated needle punching station 171, the cover layer 111 and hydrophilic foam layer 112 are advanced through the machine at about ten (10) lineal feet per minute during which the needles, not shown, are operated at about 600 strokes per minute to provide 850 punctures per square inch through the cover layer 111 and hydrophilic foam layer 112 to mechanically attach the randomly oriented polyester fiber cover layer 111 to the hydrophilic foam layer 112 to form the two-layered composite material 100.

In the cross-sectional view of the composite material shown at FIG. 8, the result of connecting the cover layer 111 to the foam layer 112 by needle punching shows how the randomly oriented polyester fibers 169 have been forcibly impaled in the needle punching machine 171 so that they penetrate through the surface of the cover layer 111 into and through the hydrophilic foam layer 112 to force some of the fibers to extend out of the bottom surface of the foam layer 112. When needle punching is used to connect the cover layer 111 to the foam layer 112 to establish the composite material 100, the layer of randomly oriented polyester fibers forming the cover layer 111 are reduced to a generally non-measurable thickness, impart a fabric feel to the top or upper surface of the formed composite material and these polyester fibers act as a wick to distribute and transfer moisture or bodily fluids from the cover layer 111 to the hydrophilic foam layer 112 to achieve the advantages of the present invention. Additionally, the polyester fibers provide a top or cover layer 111 for the formed composite material 100 which will withstand abrasion. Furthermore, the needle punching provides channels through the cover layer 111 and foam layer 112 through which moisture or body fluids may travel, thereby enhancing the distribution and transfer of these liquids from the cover layer 111 to the foam layer 112. For this reason, needle punching is a preferred means of bonding the cover layer 111 to the foam layer 112.

Three-layered forms of composite material, in accordance with the present invention, can be achieved when stronger self-sustaining forms of the composite material are required or when more accurate forms of the composite material are needed for thermoforming of three-dimensional shapes. This may be obtained by discharging the polymerizing combined mixture 132*a* directly onto some form of non-woven or felted non-woven fibers, as is shown at FIG. 12 of the drawings. Thus, by reference to FIG. 12, a roll 158, shown in phantomized form, carries a web of non-woven fibers or felted non-woven fibers 159 for providing this form of the base or for foam layer 112. These non-woven fibers or felted non-woven fibers are so delivered and introduced onto the advancing conveyor belt 132 that the non-woven fibers or felted non-woven fibers 159 will be positioned between the upper surface of the bottom release paper 132*b* and the polymerizing combined mixture 132*a* being discharged from the dispensing nozzle 145.

Those skilled in the art will readily understand that the polymerizing combined mixture 132*a*, when cast onto non-woven or felted non-woven fiber webs, now goes through the same sizing steps and the peeling off of the top and bottom release papers as was first described for the formation of the stock sheets of the hydrophilic foam layer 112.

The amount or degree of sizing and compression which the polymerizing combined mixture 132*a* undergoes establishes the voids or interstitial spaces between the fibers in the non-woven fiber or felted non-woven fiber materials used. In general, as shown in FIGS. 10A, 10B and 10C, the lesser the degree of compression, the greater will be the volume of the polymerized combined mixture 132*a* in the voids 123 or interstitial spaces between the fibers 122 of the particular non-woven fiber web or felted non-woven fiber web materials used. Conversely, the greater the degree of compression, the less the volume of polymerized combined material 132*a* so that the fibers 122 of the non-woven fiber web or felted non-woven fiber web material used will then only be coated on their outer surfaces and the greater will be the extent of the voids or interstitial spaces between the fibers, as shown by the enlarged fragmentary FIGS. 10A, 10B and 10C of the drawings.

While the needle punching bonding technique is illustrated and above described, those skilled in the art will recognize that there are other ways for connecting the cover layer 111 to the hydrophilic foam layer 112 to form the composite material 100. Thus, it is possible to substitute, in place of a randomly oriented polyester fiber 168, material known as "sock liner" which can be positioned progressively, by adhesive bonding, to the moving upper surface of the foam layer 112 to form the composite material 100. A urethane adhesive for this purpose is manufactured and sole by Mace Adhesives of Dudley, Mass. and is readily available in the commercial marketplace. This and other adhesives that are used for this purpose must not block the transfer of moisture or body fluids from the cover layer 111 to the foam layer 112 of the formed composite material 100. FIG. 10 shows a cross-section of composite material using a woven "sock liner" material 125 and a urethane adhesive 126.

Another method of connecting the cover layer 111 to the foam layer 112 to form the composite material 100 is by advancing the foam layer 112 with the layer of "sock liner" on the upper surface of the foam layer 112 into a radio frequency heat energy devices. In such radio frequency heat energy device the cover layer 111 will be bonded to the foam layer 112 to form the composite material in accordance with the present invention. Other methods of connecting the cover layer 111 to the foam layer 112 to form the composite material 100 is by conventional flame bonding techniques, or by directly polymerizing the foam layer 112 onto the cover layer 111, again by conventional means.

It has been found that bonding of the cover layer 111 and the foam layer 112 to form the composite material 100 can be used in conjunction with the molding or cutting of the composite material into three-dimensional shapes to provide products such as insoles, and incontinent pads.

This is shown in FIG. 13 of the drawings in which a radio frequency heat energy device is shown by the phantomed lines at 172 and the molding press generally designated 173 with top molding die 174*a* and bottom molding die 174*b*. The top molding die 174*a* and bottom molding die 174*b* are shaped and configured as coacting male and female units for cutting the three-dimensional product from the formed composite material. When the dies are open as shown in FIG. 13 and the composite material 100 is advanced into position on the female die, the male die is moved to the closed position to form and cut the three-dimensional product such as the insole illustrated at FIGS. 7 and 9 from the advancing composite material 100 so that it will drop out of the molding press 173. The scrim or remaining portion of the advancing composite material 100 can be conveniently collected on a take-up roller 175.

The radio frequency heat energy devices and the molding press are well known devices and accordingly are not more fully described. Those skilled in the art will also recognize that the molding device 172 can be used with composite material 110 formed at the needle punching station 171 in order to provide the three-dimensional products such as insoles and incontinent pads. Similarly, the needle punching station 171 may be taken out of operation to permit the cover layer 111 and base layer 112 to be adhesively bond or to be bonded by radio frequency heat energy device 172.

When a thermoformable acrylic latex emulsion is added to the given aqueous mixture and then mixed and blended in a predetermined ratio with the hydrophilic urethane prepolymer, the composite material 110 formed from the hydrophilic foam layer 112 will mold well into three-dimensional products to produce fine details, decorative impressions and logos. Further, the dielectric properties of the respective cover layer 111 and foam layer 112 lends itself to the formation of the composite material by short cycle time for radio frequency heat energy bonding which acts to raise the temperature of the cover layer 111 and foam layer 112 above the thermoplastic temperature of 270.degree. F. for setting and bonding the layers to form the composite material 110.

Examples of Aqueous Mixtures and the Predetermined Ratios with Hydrophilic Urethane Prepolymers.

In the examples which follow, the ingredients were introduced and mixed well between the additions of the respective ingredients to establish the wide variety of aqueous mixture for mixture with the hydrophilic urethane prepolymer first to establish the hydrophilic foam layer 112. Then by combining the hydrophilic foam layer 112 with the cover layer 111, the composite material 110 in accordance with the present invention is formed, all of which has been above described.

Example 1

One form of aqueous mixture included the following ingredients:

_____Ingredients Percent by Weight _____Water 62.58 Surfactant (BASF F88 PLURONIC) 6.95 Citric Acid 0.51 Acrylic Emulsion (UCAR 154) 26.06 Super-absorbent polymer 3.90 (Stockhausen SAP 800HS) _____

This aqueous mixture was then metered and mixed with a hydrophilic urethane prepolymer such as "BIPOL" in a ratio of 2.95 to 1.00 by weight to provide a combination which polymerizes as it moves on the conveyer belt 33 into the sizing and compressing steps as above described before it is combined with the cover layer to form the composite material in accordance with the present invention.

The inclusion of the citric acid served to lower the pH of the water permitted the concentration of the super-absorbent polymer to be increased without interfering with the pumping characteristics of the aqueous mixture or the combination for forming the hydrophilic foam layer 12 of the composite material 10 formed.

Example 2

Another form of the aqueous mixture included the ingredients as follows:

_____Ingredients Percent by Weight _____Water 79.53 Surfactant (BASF F88 PLURONIC)0.81 Citric Acid 0.62 Super-absorbent polymer 1.53 (Stockhausen SAP 800HS) Bactericide 0.83 _____

This aqueous mixture was metered and mixed with hydrophilic urethane prepolymer "BIPOL" in a ratio of 5.20 to 1.00 by weight onto a layer of non-woven fiber web material on the conveyer belt where the combination of the polymerizing mixture and the layer of non-woven fiber web material were sized and compressed to 25% of the thickness which provided a hydrophilic foam layer having voids between the fiber filler.

The non-woven fibers from Union Wadding and Carr Lee were selected because they contained a semi-cured acrylic binder which facilitated in the formation of the composite material and the thermoforming of products from such composite material.

Example 3

The combination of the aqueous mixture and the hydrophilic urethane prepolymer of Example 2 was also deposited on a layer of felted non-woven fiber web on the conveyer belt 33. Then the combination of layers of material were sized and compressed to 10% of the thickness. This provided a hydrophilic foam layer 12 wherein the fibers were coated with interstitial voids. The composite material formed from this type of hydrophilic foam layer 12 was found to thermoform well into products such as insoles, incontinent pads in accordance with the present invention.

Example 4

This aqueous mixture was formed with thermoformable acrylic latex emulsion additives because it was found that the glass transition temperature and pH of the acrylic latex emulsion aided in providing an improved aqueous mixture. The ingredients for this form of the aqueous mixture were as follows:

_____Ingredients Percentage by _____Weight Water 46.35 Surfactant (BASF F88 Pluronic) 5.15 Citric Acid 0.38 Acrylic Emulsions (UCAR 154) 19.30 Super-absorbent Polymer 2.89 (Stockhausen SAP 800HS) _____

This aqueous mixture was combined with hydrophilic urethane prepolymer "BIPOL" in a ratio of 3.00 to 1.00 by weight. This mixture was deposited on a ½" of non-woven fiber web material moving at a rate of 9 feet per minute on the conveyer belt 33 and produced a composite material which thermoformed well in accordance with the present invention.

Example 5

This aqueous mixture produced a composite material with improved thermal properties. The ingredients were as follows:

_____Ingredients Percent by Weight _____Water 70.1 Surfactant (BASF F88 PLURONIC) 0.8 Citric Acid 0.6 Super-absorbent Polymer 1.5 (Stockhausen SAP 800 HS) Thermal Phase Change Material 9.5 (Thermosorb 65, PCM) Bactericide 0.8 _____

This aqueous mixture was combined with hydrophilic urethane prepolymer in a ratio of 5.20 to 1.00.

When the composite material was formed, it was found that the products had more thermal protection and took two percent (2%) of the time for cold to penetrate the composite material formed.

Example 6

The versatility of the present invention to vary the composite material without impairing the characteristics of the hydrophilic foam layer of the composite material is illustrated by the present example in which the composite material is made more flexible by the addition of reclaimed rubber tire particles. Thus the ingredients for this aqueous mixture are as follows:

_____Ingredients Percentage by _____Weight Water 31.03 Surfactant (BASF F88 PLURONIC) 1.60 Citric Acid 0.77 Super-absorbent Polymer 1.92 (Stockhausen SAP 800HS) Bactericide 0.80 Rubber Particles 6.75 (VISITRON 4010) NMP Solvent 2.00 _____

This aqueous mixture was combined with the hydrophilic urethane prepolymer (BIPOL) in a ratio of 1 to 1 and was cast on a non-woven fiber web material. It was found to double the density of the composite material formed to approximately 13 lbs./cu. ft., increased the resiliency of the products formed from the composite material, yet maintained and did not impair the absorption characteristics of the hydrophilic foam layer of the composite material.

Example 7

This example of the aqueous mixture provides a composite material having odor absorption characteristics. It includes the following ingredients:

_____Ingredients Percentage by _____Weight Water 57.7 Surfactant (BASF F88 Pluronic) 2.0 Citric Acid 1.3 Super-absorbent polymer 3.2 (Stockhausen SAP 800HS) Bactericide 1.0 Green Tea (Ikeda, Japan) 14.8 _____

The aqueous mixture was combined with the hydrophilic urethane prepolymer "BIPOL" in a range of 4.00 to 1.00, and was deposited on a non-woven fiber web to form the hydrophilic foam layer for the composite material.

Products formed from the composite material were tested and found to absorb cigarette smoke very well.

Thus, there have been described various embodiments for composite materials and illustrations of components formed therefrom for various uses and purposes; however, variations and substantial equivalents thereof can be readily developed by those skilled in the art and these are deemed to be included within the scope of the appended claims.

Figure 14:
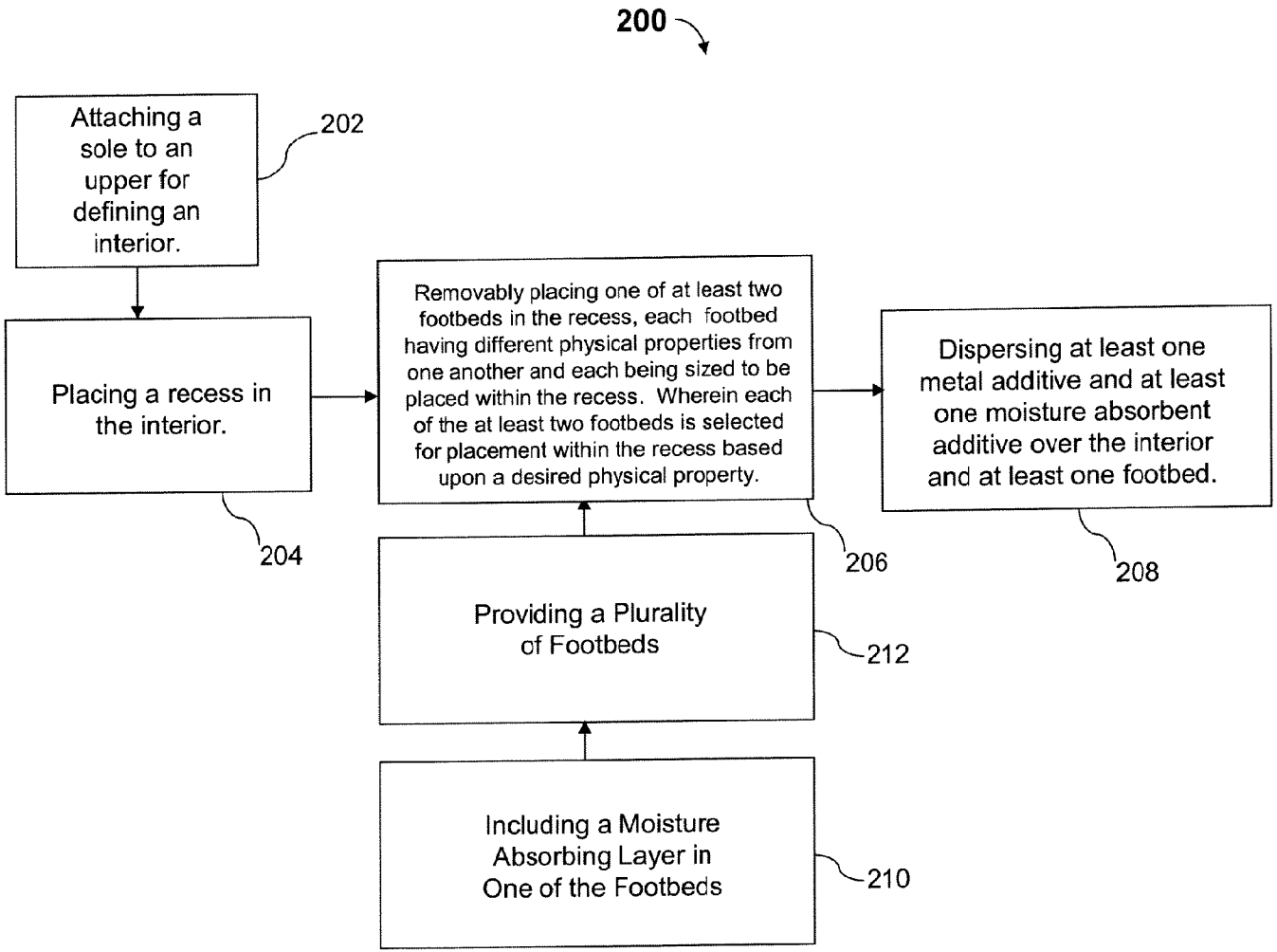
FIG. 14 depicts a method of providing the shoe shown in FIG. 1.

As shown in FIG. 14, method 200 of providing the shoe is shown, including the steps of attaching 202 a sole to an upper for defining an interior, placing 204 a recess in the interior, and removably placing 206 one of at least two footbeds in the recess, each footbed having different physical properties from one another and each being sized to be placed within the recess. Method 200 also disperses 208 at least one metal additive and at least one moisture absorbent additive over the interior and at least one footbed.

It is understood that each of the at least two footbeds is selected for placement within the recess based upon a desired physical property.

In some embodiments, method 200 also includes 210 a moisture absorbing layer. In other embodiments, method 200 provides 212 a plurality of footbeds, each having different physical properties; placing at least a second recess in the interior and removably placing one of at least a second plurality of footbeds in the at least second recess, each having different physical properties and each being sized to be placed within the at least second recess.

What is claimed is:

1. A shoe, comprising:

a sole attached to an upper for defining an interior;

said interior having a recess;

at least two footbeds, each having different physical properties and each being sized to be placed within said recess;

an additive dispersed over said interior and at least one footbed;

wherein each of said at least two footbeds is removably placed within said recess depending upon a desired physical property;

wherein said interior includes a front wall; and at least a second recess in said front wall and at least a second plurality of footbeds, each having different physical properties and each being sized to be placed within said at least second recess.

2. The shoe according to claim 1, further comprising a plurality of footbeds, each having a different physical property than a next footbed.

3. The shoe according to claim 1, wherein said additive is selected from the group consisting of silver metal, silver chloride, super-absorbent, and combinations thereof.

4. The shoe according to claim 1, wherein said additive is dispersed over an entire interior.

5. The shoe according to claim 1, further comprising at least a second additive, wherein said additive and said at least second additive are different metals.

6. A shoe, comprising:

a sole attached to an upper for defining an interior;

said interior having a recess;

at least two footbeds, each having different physical properties and each being sized to be placed within said recess;

at least one metal additive and at least one moisture absorbent additive dispersed over said interior and at least one footbed;

wherein each of said at least two footbeds is removably placed within said recess depending upon a desired physical property;

wherein said interior includes a side wall, a rear wall, and a front wall;

a plurality of footbeds, each having a different physical properties;

at least a second recess in said front wall, said rear wall, and said side wall; and at least a second plurality of footbeds for placement in said at least second recess each having different physical properties and each being sized to be placed within said at least second recess.

7. The shoe according to claim 6, wherein at least one of said at least two footbeds further includes a moisture absorbing layer.

8. The shoe according to claim 6, wherein said additive is dispersed over one of said at least second plurality of footbeds.

9. The shoe according to claim 6, wherein said at least one moisture absorbing additive is a super-absorbent.

10. A method of providing a shoe, comprising the steps of:

attaching a sole to an upper for defining an interior;

placing a recess in the interior;

removably placing one of at least two footbeds in the recess, each footbed having different physical properties from one another and each being sized to be placed within the recess;

dispersing at least one metal additive and at least one moisture absorbent additive over the interior and at least one footbed;

wherein each of the at least two footbeds is selected for placement within the recess based upon a desired physical property;

including a front wall on the interior and a second recess in the front wall; and removably placing one of at least a second plurality of footbeds in the second recess, each footbed having different physical properties from one another and each being sized to be placed within the second recess.

11. The method according to claim 10, further comprising the step of including a moisture absorbing layer.

* * * * *